United States Patent [19]

Tourasse et al.

[11] 4,343,114

[45] Aug. 10, 1982

[54] APPARATUS FOR MACHINING CAMS AT A CONSTANT CUTTING SPEED

[76] Inventors: Marc Tourasse, 53 Chemin de la Garenne, Lyon 50, Rhône; Roger Duvernay, 16 Allée de Longchêne, Saint Genis Laval, Rhône, both of France

[21] Appl. No.: 163,721

[22] Filed: June 27, 1980

[30] Foreign Application Priority Data

Jun. 29, 1979 [FR] France ..... 79 17425

[51] Int. Cl.[3] ..... B24B 5/42

[52] U.S. Cl. ..... 51/165.71; 51/101 R

[58] Field of Search ..... 51/97 NC, 101 R, 165.71

[56] References Cited

U.S. PATENT DOCUMENTS

| | | | |
|---|---|---|---|
| 4,102,082 | 7/1978 | Katsumi | 51/101 R |
| 4,122,634 | 10/1978 | Nishimura | 51/101 R |
| 4,214,309 | 7/1980 | Koide | 51/97 NC |
| 4,262,454 | 4/1981 | Iida | 51/101 R |

FOREIGN PATENT DOCUMENTS

| | | | |
|---|---|---|---|
| 2712029 | 9/1978 | Fed. Rep. of Germany | 51/97 NC |
| 55-222 | 1/1980 | Japan | 51/101 R |
| 52-76794 | 6/1977 | Japan | 51/101 R |

*Primary Examiner*—Harold D. Whitehead

*Attorney, Agent, or Firm*—Basile, Weintraub & Hanlon

[57] ABSTRACT

This invention relates to apparatus for facilitating the maching of cams at a constant cutting speed. A cam is mounted betwen points on the same geometric axis as a reproduction template or master cam and cooperates with a roller to cause pivotal movement of a machining member to generate the desired shape on a workpiece or cam. The apparatus includes a memory for storing predetermined theoretical instantaneous values of the speed of rotation of the cam that must be implemented such that the cutting speed remains the same at any point around the cam. A speed varying arrangement is responsive to the instantaneous angular orientation of the cam, the predetermined theoretical value of the speed of rotation of the cam at each instant and the instantaneous speed of the motor for varying the speed of rotation of the cam such that the cutting speed remains the same at any point around the periphery of the cam.

4 Claims, 5 Drawing Figures

APPARATUS FOR MACHINING CAMS AT A CONSTANT CUTTING SPEED

BACKGROUND OF THE INVENTION

1. Field Of The Invention

The present invention relates to apparatus for facilitating the machining of cams at a cutting speed which remains constant.

The invention relates in particular and advantageously to the trueing of cams on a grinder provided with a wheel removing only a machining allowance of several tenths of a millimeter from the work-piece. In this case, the approximate shape of the contour of the work-piece has been obtained previously by another machining method, for example by turning or milling.

2. Description Of The Prior Art

For this method of machining, a cam is mounted between points on the geometric axis as a template referred to as the "master cam". This master cam is a reproduction member of appropriate shape which rests on a roller which is free to rotate but which is itself set in rotation in order to bring about a pivotal movement of the arrangement comprising the master cam and the cam whereas the wheel generates the desired shape on the cam.

In view of the fact that the master cam and the cam rotate at a constant speed without taking into account variations in the radius of the cam, it follows that the cutting speed of the wheel is variable. Thus, in certain areas where the cutting speed is low, the metal is easily removed by the wheel, whereas in certain areas where the cutting speed is very high, the wheel does not have time to remove the metal and the work-piece flexes in front of the wheel. In fact, the axis of rotation of the work-piece, which is not infinitely rigid, moves back in front of the wheel which results in a deformation of the contour machined.

By unduly increasing the number of rotations of the work-piece in front of the wheel, it is possible to lessen this defect, however, without eliminating it completely. This method is troublesome, since it increases the trueing time which justly constitutes one of the important parameters of the manufacturing cost of the cam.

SUMMARY OF THE INVENTION

The object of the invention is to provide a device which is capable of obviating the aforesaid drawbacks while making it possible to obtain a cutting speed which is virtually constant over the entire periphery of the cam.

A further object of the invention is to provide a device for making it possible to true cam-shafts for motor vehicles or other motor driven appliances rapidly and with great precision.

A device, according to the invention, is disclosed for machining a cam mounted between points on a support which is mounted to oscillate about an axis parallel to the axis of rotation of the cam. The support also supports a reproduction templte or "master cam" coaxial with the cam. Motorized means are provided to ensure the rotation of the cam and of the master cam which cooperate respectively with a follower member and with a cutting member. The device of this invention is characterized in that is comprises a memory means for storing predetermined theoretical instantaneous values of the speed of rotation of the cam that must be implemented such that the cutting speed remains the same at any point around the cam. The device also includes means, responsive to the instantaneous angular orientation of the cam, the predetermined theoretical value of the speed of rotation of the cam in each instant and the instantaneous speed of the motor means, for varying the speed of rotation of the cam such that the cutting speed remains the same at any point around the periphery of the cam.

According to an additional feature of this invention, the apparatus includes an electronic controller which receives signals from an encoder which indicates the angular orientation of the cam at each instant. The controller comprises suitable circuitry which addresses the particular location in the memory associated with the measured instantaneous angular orientation of the cam at a particular instant and receives the value stored at the addressed memory location. The controller then provides an output signal which is proportional to the desired instantaneous speed of rotation of the cam.

According to an additional feature of this invention, a speed varying means receives the output signal from the controller and a signal emitted by a tachometer pick-up connected to the output shaft of the motor which sets the cam in rotation. The speed varying means compares the two signals and, at each instant, corrects the supply voltage to the motor in order to reduce to zero the difference between the two signals to thereby insure that the cutting speed is maintained constant around the entire periphery of the cam.

According to an additional feature of the invention, in the case of a one-piece work-piece comprising several co-axial cams, such as a cam shaft, a master cam is provided comprising a template surface for each particular cam and the memory has stored therein the various laws of variation of the speed of rotation of each master cam.

According to an additional feature of the invention, the motor which sets the cam in rotation is preferably a d.c. motor capable of producing considerable torque.

According to an additional feature of the invention, the rotary arrangement comprising the cam or cams and the master cam has low inertia in order to facilitate successive accelerations and decelerations of the rotary arrangement with a response time which is as short as possible.

According to an additional feature of the invention, the device is mounted on a grinder, the follower member which cooperates with the master cam being constituted by a roller which is free to rotate.

According to a variation of the invention, the device is mounted on a lathe and the follower member which cooperates with the master cam is constituted by a pin having contact with the master cam at one point.

BRIEF DESCRIPTION OF THE DRAWINGS

The accompanying drawings, given as non-limiting examples, will make it easier to understand the features of the invention.

DESCRIPTION OF THE PREFERRED EMBODIMENTS

Figure 1:
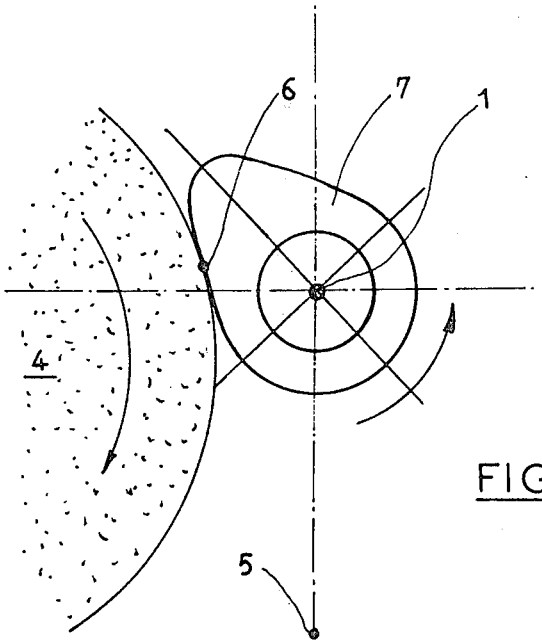
FIGS. 1 and 2 are diagrammatic views to assist in understanding the problem encountered.

The device according to the invention may be provided on various types of machines. However, in the following description, we shall consider the particular case of adapting the device to a grinder of the type used for the precision machining of cam profiles in general and motor vehicle cam-shafts in particular.

On a grinder of the said type, the cam or cam-shaft 7 is mounted between points on the same geometric axis 1 as a "master cam" 2 (FIG. 3) which is a reproduction member of appropriate shape. By pressing on a roller 3 which is free to rotate and which is fixed on the machine, the master cam 2 causes a pivotal movement of the moving arrangement comprising the master cam 2 and work-piece 7 held between the points, which enables a wheel 4 to generate the desired shape on the work-piece 7 to be machined.

The wheel 4 thus removes the machining clearance by moving several tenths of a millimeter in the direction of the work-piece 7, it being understood that the approximate general shape of the contour has been formed previously on the work-piece 7 by another machining method, for example by turning or milling.

The diagram of FIG. 1 shows the principle used for generating the shape of the cam. Thus the geometric axis 1 moves away from and towards the wheel 4 while oscillating about an axis 5 parallel to the axis 1.

Figure 2:
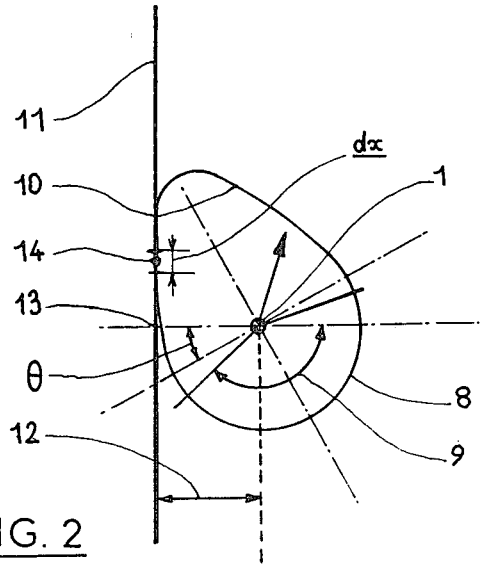

The point 6 is the point of contact between the wheel 4 and the work-piece 7, at a given instant. In order to understand the problem which the present invention proposes to resolve, the cam 7, by way of example, (FIG. 2) comprises a circular portion 8 subtended by an angle 9 and a portion 10 whereof the shape is defined by a law referred to as the "law of lift".

Figure 3:
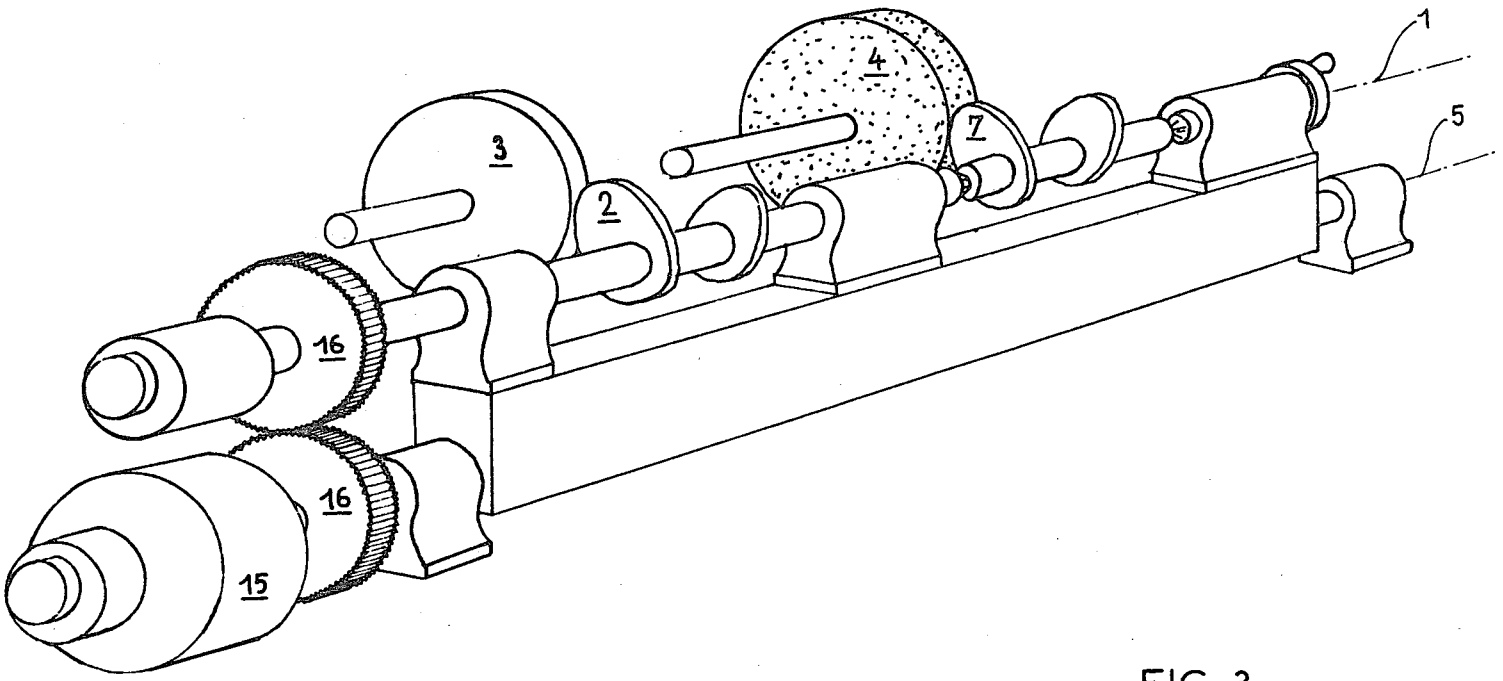
FIG. 3 is a perspective view of a grinder equipped with a device constructed according to the invention.

By way of simplification, it will be considered that the diameter of the wheel 4 is infinite. Thus, in the vicinity of the work-piece 7, the circumference of the wheel 4 is constituted by a straight line 11 sometimes referred to as a "flat follower" (FIG. 3). In this case, the law of lift gives the value of the distance 12 separating the axis 1 from the straight line 11 depending on the angular orientation of the work-piece, this angular orientation is defined for example by an angle $\theta$.

Since the work-piece 7 carries out a rotary movement at a constant speed while remaining in contact with the straight line 11, all the points of the circular portion 8 come into contct with this straight line at the same point 13 located on the perpendicular to the straight line 11 which passes through the axis 1 in the plane of the figure. The speed of passage of the circular portion 8 at the point 13 is constant and it is always so when a cylindrical work-piece of revolution is trued, each surface element dx of the work-piece 7 remaining in contact with the wheel 4 for the same time dt. This is no longer so when it is the portion 10 which is in contact with the straight line 11. In fact, it is easy to show that the point of contact 14 between the work-piece and the straight line 11 moves at a variable speed along the contour of the portion 10 of variable radius and that this speed at a given point depends on the value of the distance 12 at this point, i.e. on the lift of the cam at the point in question.

This complicates the problem of trueing cams, since each small element of the contour dx does not remain in front of the wheel 4 for a constant time, so that the metal is easily removed at the points where the speed is low whereas at the points where this speed is high, the wheel 4 does not have time to remove the metal. At thses points, the work-piece 7 flexes in front of the wheel 4 since the axis of rotation of the work-piece 7 which is not infinitely rigid draws back before the wheel 14 and this results in a deformation of the contour.

by unduly increasing the number of rotations of the work-piece 7 in front of the wheel 4, it is possible to lessen this defect, but not to eliminate it completely. This is troublesome owing to the resulting increase in trueing time, the trueing time being one of the important parameters of the cost of the cam, especially in the case of cams for a motor vehicle engine, which are mass manufactured parts.

The object of the invention is thus to provide a system making it possible to ensure movement at a constant speed of the point of contact with the wheel 4 all around the cam 7, in order that the machining speed remains virtually constant over the entire periphery of the cam 7. For this, it is necessary that the motor 15 which sets the work-piece 7 in rotation through the intermediary of reduction gearing 16 (FIGS. 3 and 4) rotates at a variable speed, the variation of the speed having to be exactly the same for each revolution of the work-piece, in order to remove the metal at a constant rate and with constant forces, at least in the period of finishing the work-piece, at the time when the wheel produces the profile with precision.

Figure 5:
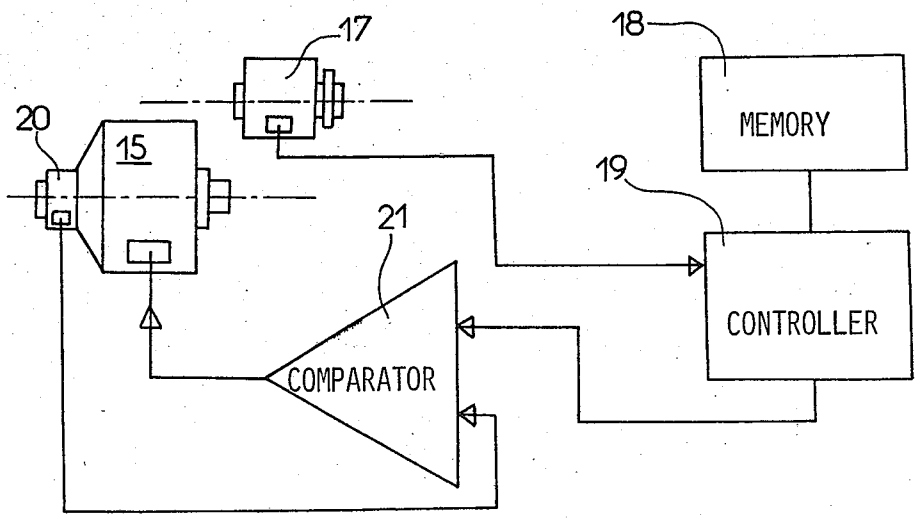
FIG. 5 is a diagram showing the members for monitoring and controlling the device according to the invention.

As can be seen in FIG. 5, the apparatus of this invention comprises, in addition to the motor 15, a memory means 18 for storing predetermined theoretical instantaneous values of the speed of the rotation of the cam that must be implemented such that the cutting speed remains the same at any point around the cam and means, responsive to the instantaneous angular orientation of the cam, the predetermined theoretical value of the speed of rotation of the cam at each instant and the instantaneous speed of the motor 15, for varying the speed of rotation of the cam such that the cutting speed remains the same at any point around the periphery of the cam.

In this case, it is very important that the torque of the motor 15 and the inertia of all of the mechanical parts which are driven by the motor 15, are compatible with the desired successive accelerations and decelerations along the contour of the cam. An electric d.c. motor is preferably used, which is capable of producing relatively high torque.

The memory means 18 is an electrical memory, for example, in which there are stored at predetermined memory locations the desired value of the speed of rotation of the motor 15 for each orientation of the cam 7, this resulting from a division of a complete rotation of the cam into N equal parts. N may be as large as desired, these values being able to be calculated from the law of lift, for example, by fixing a value of the speed of rotation along a circular portion of the cam.

The apparatus also includes an encoder 17 which is an absolute electrical encoder fixed mechanically on the axis of the master cam 2. The encoder 17 makes it possible to indicate each angular orientation of the cam 7 with respect to an origin defined in advance, for example, from the beginning of the law of lift, corresponding to the instant when the lift of the valve or mechanical part controlled by the cam begins.

The electronic controller 19, which is preferably located outside of the machine, receives the output signals from the encoder 17, the latter indicating the angular orientation of the work-piece or cam 7 at each instant. The controller 19 addresses the memory 18 at the particular memory location corresponding to the angular orientation of the cam 7 at the particular instant and receives therefrom the signal whose value corresponds to the predetermined theoretical instantaneous value of the speed of rotation of the cam at the particular instant. The controller 19 includes a d.c. voltage amplifier which supplies a voltage signal whose magnitude is proportional to the signal received from the member 18 which is the predetermined theoretical value of the desired speed of the cam 7. The amplifier is chosen so that it is capable of delivering a voltage which is sufficient to make it possible to obtain, from the d.c. electric motor 15, the torque and consequently the acceleration which enable the speed of rotation of the cam 7 to follow the law calculated.

As any conventional addressing circuitry may be utilized in the controller 19, further details regarding the exact arrangement of the components of the controller 19 will not be described further.

The apparatus further includes means, connected to the output shaft of the motor 15, for providing a signal whose magnitude is proportional to the instantaneous speed of the motor 15. Preferably, this means comprises a tachometric generator 20.

The output from the tachometric generator 20 along with the output signal from the amplifier in the controller 19 are input to a comparator 21, the output of which is connected to the voltage supply of the motor 15. The comparator 21 compares the signal from the tachometric generator 20 which indicates the instantaneous value of the speed of the motor 15 and the signal from the controller 19 which corresponds to the desired theoretical instantaneous value of the speed of rotation of the motor 15. The difference between the two signals or voltages, or "error voltage", is used to correct the voltage supply to the motor 15 and to reduce this error voltage to zero. The use of the tachometric generator 20 makes it possible to close the operating loop of the servo mechanism utilized in this invention.

It is known that a cam-shaft, such as for example that of a motor vehicle, comprises a certain number of cams intended to lift various mechanism, such as valves, each disposed at a predetermined angle of keying with respect to the cam shaft.

Figure 4:
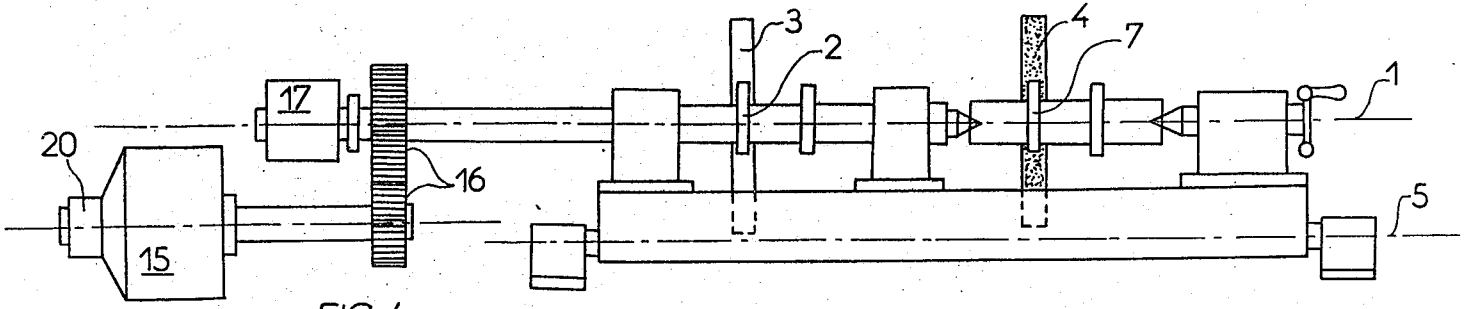
FIG. 4 is a front view of the grinder.

Thus, according to an additional feature of the invention, the bed of the machine supporting all the mechanical parts illustrated in FIG. 4 is capable of moving laterally after trueing of each cam of the cam shaft in order to place the following cam opposite the wheel 4 and to recommence the trueing operation on the latter cam. Each position of the bed includes an electrical contact which informs the controller 19 of the position of the bed, thus identifying the cam to be trued, in order that the controller 19 fixes the origin of the angle of orientation of the cam with respect to the indications of the encoder.

The controller 19 fulfills an additional function, which is to bring about the monitor of the original unkeying of each cam, naturally after the unkeying values corresponding to the respective cams have been introduced into the memory.

Although the above description relates to the particular case of an application of the invention to operations of machining by grinding, it is obvious that the invention also relates to various other cases.

Thus, it goes without saying that the above described device is applicable for any other machining method, such as milling, using a circular tool of sufficiently large dimensions in order that the movement of the point of contact along a line 11 (FIG. 2) for example causes variations of speeds along the contour to be generated which are detrimental to the desired precision.

The invention also relates to the case of machining methods in which the tool has a contact at one point in the the place containing the cam, as is the case for turning on a lathe.

What is claimed is:

1. A device for machining a cam mounted between points on a support mounted to oscillate about an axis parallel to the axis of rotation of a cam, this support also supporting a master cam co-axially with the cam, whereas motorized means insure the drive of the cam and of the master cam which cooperate respectively with a follower member and with a cutting member, characterized in that it comprises:

memory means for storing predetermined theoretical instantaneous values of the speed of the rotation of the cam that must be implemented such that the cutting speed remains the same at any point around the cam;

encoder means, coupled to the cam, for providing a first signal indicating the instantaneous angular orientation of the cam;

means, responsive to the output from the memory means and the first signal from the encoder means, for providing a second signal whose magnitude is proportional to the predetermined theoretical instantaneous value of the speed of the rotation of the cam at each predetermined angular orientation of the cam;

means, connected to the output shaft of the motor means, for providing a third signal whose magnitude is proportional to the instantaneous speed of the motor means; and means for varying the speed of rotation of the cam such that the cutting speed remains the same at any point around the cam;

the speed varying means including means for comparing the second and third signals and adjusting the magnitude of the voltage supply to the motor means at each instant in order to reduce to zero the difference between the magnitude of the second and third signals.

2. The device according to claim 1 in the case of a one-piece work-piece comprising a plurality of co-axial disposed cams, characterized in that the master cam is provided with a template surface for each cam and the memory means stores the predetermined theoretical instantaneous values of the speed of rotation of each cam that must be implemented in order that the cutting speed remains constant around the periphery of each cam at each point.

3. The device according to claim 1 characterized in that the motor means for setting the cam in rotation is an electrical d.c. motor.

4. The device according to claim 1 characterized in that it is mounted on a grinder and the follower member is constituted by a rotatable roller and the cutting member is a grinder wheel.

* * * * *